US006695309B2

(12) United States Patent
Pepper

(10) Patent No.: US 6,695,309 B2
(45) Date of Patent: Feb. 24, 2004

(54) MODULAR HIDDEN MAZE GAME

(76) Inventor: Martin Pepper, 186 Pinehurst Ave., Apt. 2D, New York, NY (US) 10033

( * ) Notice: Subject to any disclaimer, the term of this patent is extended or adjusted under 35 U.S.C. 154(b) by 0 days.

(21) Appl. No.: 10/131,609

(22) Filed: Apr. 24, 2002

(65) Prior Publication Data

US 2003/0201603 A1 Oct. 30, 2003

(51) Int. Cl.[7] ..... A63F 3/00

(52) U.S. Cl. ..... 273/242; 273/282.1; 273/283; 273/285; 273/287; 273/290

(58) Field of Search ..... 273/238, 255, 273/262, 282.1, 282.2, 282.3, 283, 285, 287, 288, 290, 242

(56) References Cited

U.S. PATENT DOCUMENTS

| | | | | | |
|---|---|---|---|---|---|
| 429,250 | A | * | 6/1890 | Sperl | 273/267 |
| 1,327,907 | A | * | 1/1920 | Currie | 273/267 |
| 1,666,359 | A | | 4/1928 | Steves | |
| 3,025,063 | A | * | 3/1962 | Magee | 273/249 |
| 3,404,890 | A | | 10/1968 | Christy | |
| 3,495,831 | A | * | 2/1970 | Healy | 273/243 |
| 3,516,671 | A | | 6/1970 | Estrin | |
| 3,633,913 | A | * | 1/1972 | Solimene | 273/153 S |
| 3,768,811 | A | * | 10/1973 | Goldfarb et al. | 273/261 |
| 3,863,926 | A | * | 2/1975 | White et al. | 273/267 |
| 4,004,810 | A | | 1/1977 | Henrie | |
| 4,047,720 | A | * | 9/1977 | Galdal | 273/275 |
| 4,057,253 | A | * | 11/1977 | Csoka | 273/153 R |
| 4,244,580 | A | | 1/1981 | Hoyles | |
| 4,465,280 | A | | 8/1984 | Dimitrin | |
| 4,486,017 | A | * | 12/1984 | Evert, Jr. | 273/153 S |
| 4,508,351 | A | | 4/1985 | Fitzgerald | |
| 4,614,344 | A | | 9/1986 | O'Connor | |
| 4,647,049 | A | * | 3/1987 | Oretsky et al. | 273/264 |
| 4,850,592 | A | | 7/1989 | Winter | |
| 4,979,749 | A | * | 12/1990 | Onanian | 235/90 |
| 5,333,878 | A | | 8/1994 | Calhoun | |
| 5,411,260 | A | | 5/1995 | Smith | |
| 5,464,224 | A | | 11/1995 | Rosenbaum | |
| 5,499,815 | A | | 3/1996 | Attaya | |
| 5,803,458 | A | | 9/1998 | Snyder | |

FOREIGN PATENT DOCUMENTS

| | | |
|---|---|---|
| GB | 2 103 941 | 3/1983 |

* cited by examiner

*Primary Examiner*—Paul T. Sewell
*Assistant Examiner*—V K Mendiratta

(57) ABSTRACT

A modular hidden maze game for multiple players is provided. In an exemplary embodiment, the game includes a playing board having a playing surface on which can be defined a plurality of playing spaces. Each of the playing spaces can include at least one recessed portion. A plurality of partition pieces can be removably attached to the playing surface at a substantially normal angle, thereby forming a plurality of mutable paths across the playing surface. A plurality of covering pieces are provided. Each of the covering pieces can be dimensioned to removably engage the recessed portion of one of the plurality of playing spaces while at least partially covering any partition pieces that abut the playing space occupied by the covering piece. The playing board can be formed of discrete modules which allow players to separate sections of the board to facilitate set up and concealment of a maze before rejoining the sections to reform the board having at least two concealed mazes thereon.

51 Claims, 7 Drawing Sheets

MODULAR HIDDEN MAZE GAME

BACKGROUND

1. Field of the Invention

The present invention is directed to a modular board game and, more specifically, to a modular board game which allows players to construct and conceal a maze thereon.

2. Discussion of Related Art

Various types of maze board games have been disclosed in the open literature. For example, in U.S. Pat. No. 4,004,810, Henrie ostensibly discloses a maze-type game having a game board segmented into six sections. Each section is used by a different player. All segments have identical, pre-loaded paths printed on a playing surface, and each segment has a different background color. Each path square has a hole for receiving a game piece. An identical number of gate elements are located at identical positions on each section. The gate elements can be opened or closed during game play. The object of the game is to be the first player to arrive at a finishing position on their section.

In U.S. Pat. No. 4,057,253, Csoka ostensibly discloses a maze board game wherein each player is provided with a maze board having a grid pattern, a paper maze sheet having the identical grid pattern of the maze board, a pencil for drawing a maze on the maze sheet, a token piece to represent player position on the board, and a plurality of partitions. The board is grooved to allow the partitions to be placed in various locations on the board. Game play begins by each player drawing a maze on the maze sheet, which remains concealed from other players during the course of the game. The players then take turns trying to move their token piece across the maze board. Each time that a player's movement would encroach on a wall, as drawn on the maze sheet, a partition is placed in a groove on the board in a manner that mirrors the wall position on the maze sheet. In this manner, the maze on the maze sheet is "discovered" in a stepwise fashion as the player moves across the board. The first player to reach a pre-designated end point is declared the winner.

In U.S. Pat. No. 5,333,878, Calhoun ostensibly discloses a game board having a plurality of game spaces, each surrounded by grooves. Each player is provided with a search piece, a plurality of orbs and a plurality of maze walls. Some of the orbs are "marked" orbs; the remainder are "decoy" orbs. The identity of each orb is printed on its underside. The game begins with each player placing all of his orbs in his section of the game board such that the identity of each orb is concealed on its underside. The players then take turns moving the search pieces across the board in search of the "marked" orbs of opposing players. The maze walls are placed and replaced in various grooves on the board during game play in order to impede the path of opposing players to the orbs. When a search piece reaches a playing space occupied by an orb, that orb is "captured" and removed from the playing board. The last player with a "marked" orb in his maze area is declared the winner.

In U.S. Pat. No. 5,464,224, Rosenbaum ostensibly discloses a game board having an array of playing spaces arranged in rows and columns thereon and a plurality of edge regions. Each edge region is disposed between a corresponding pair of playing spaces. There are two visually distinguishable "home" regions pre-loaded onto the board. A plurality of fence pieces are placed in a bag. The players move player pieces in turn across the board in an effort to reach the opposing players home region. A turn typically consists of movement of a player piece upon an adjacent space on the board; withdrawing a fence piece from the bag; and placing the same in one of the edge regions in an effort to impede the progress of the opposing player.

In U.S. Pat. No. 5,803,458, Snyder ostensibly discloses a memory game which includes a game board having a plurality of spaces forming a grid. The spaces each have a red, white, or black dot printed thereon. The dots are covered by a playing piece during normal game play. The playing pieces each have a square base and a conical handle. Game play commences with one player lifting one of the playing pieces to reveal the dot beneath. If a black dot is revealed, the player replaces the playing piece and lifts another. If a white dot is revealed, the player replaces the playing piece and another player lifts one of the playing pieces. The game continues in this manner until one of the players uncovers a red dot.

The aforementioned are just samples of the many "maze-type" board games in existence. Most of these games incorporate some form of concealment of various maze elements or variance of the maze path during play to facilitate interest. However, none of these games provide an opportunity to physically construct and conceal a multi-dimensional maze in a manner that allows an opposing player to uncover the maze in a stepwise fashion while the remainder of the maze remains concealed. The fact that so many have tried to provide hidden or randomly determined maze games with multi-dimensional elements evidences a long felt, yet unfulfilled aspiration in the gaming industry to provide a true multi-dimensional hidden maze board game.

SUMMARY OF THE INVENTION

Accordingly, the present invention is directed to a modular, multi-dimensional hidden maze game. In one embodiment, the game includes a playing board having a playing surface on which can be defined a plurality of playing spaces. Each of the playing spaces can include at least one recessed portion. A plurality of partition pieces can be removably attached to the playing surface at a substantially normal angle, thereby forming a plurality of mutable paths across the playing surface. A plurality of covering pieces can be provided. Each of the covering pieces can be dimensioned to removably engage the recessed portion of any one of the plurality of playing spaces while at least partially covering any partition pieces that abut the playing space occupied by the covering piece.

In various preferred embodiments, the game includes a playing board formed of at least two discrete modules removably attached together to form a substantially planar playing surface. A plurality of partition pieces can be removably attached to the playing surface at an angle substantially normal to the playing surface thereby forming a plurality of mutable paths thereon.

Another aspect of the present invention is directed to a playing board formed of at least two discrete modules removably attached to form a substantially planar playing surface, with each of the modules having at least one attachment portion adapted to receive a substantially rigid member. The substantially rigid member can interconnect at least two adjacent modules. The shape of the modules along with the size of the substantially rigid member and the location of the attachment portion allow the playing board to accommodate additional modules utilizing identically dimensioned substantially rigid members.

Further alternative embodiments can include a playing board formed of at least two discrete modules removably attached to form a substantially planar playing surface, wherein the playing surface includes an m by n array of playing spaces. A row of the playing spaces can be bisected such that portions of the row remain on two of the modules when the modules are separated. The row is fully formed when the modules are re-attached.

BRIEF DESCRIPTION OF THE DRAWINGS

Various features, aspects, and advantages of the present invention will become more apparent with reference to the following description, appended claims, and accompanying drawing, wherein:

DETAILED DESCRIPTION OF PRESENTLY PREFERRED EMBODIMENTS

Figure 1:
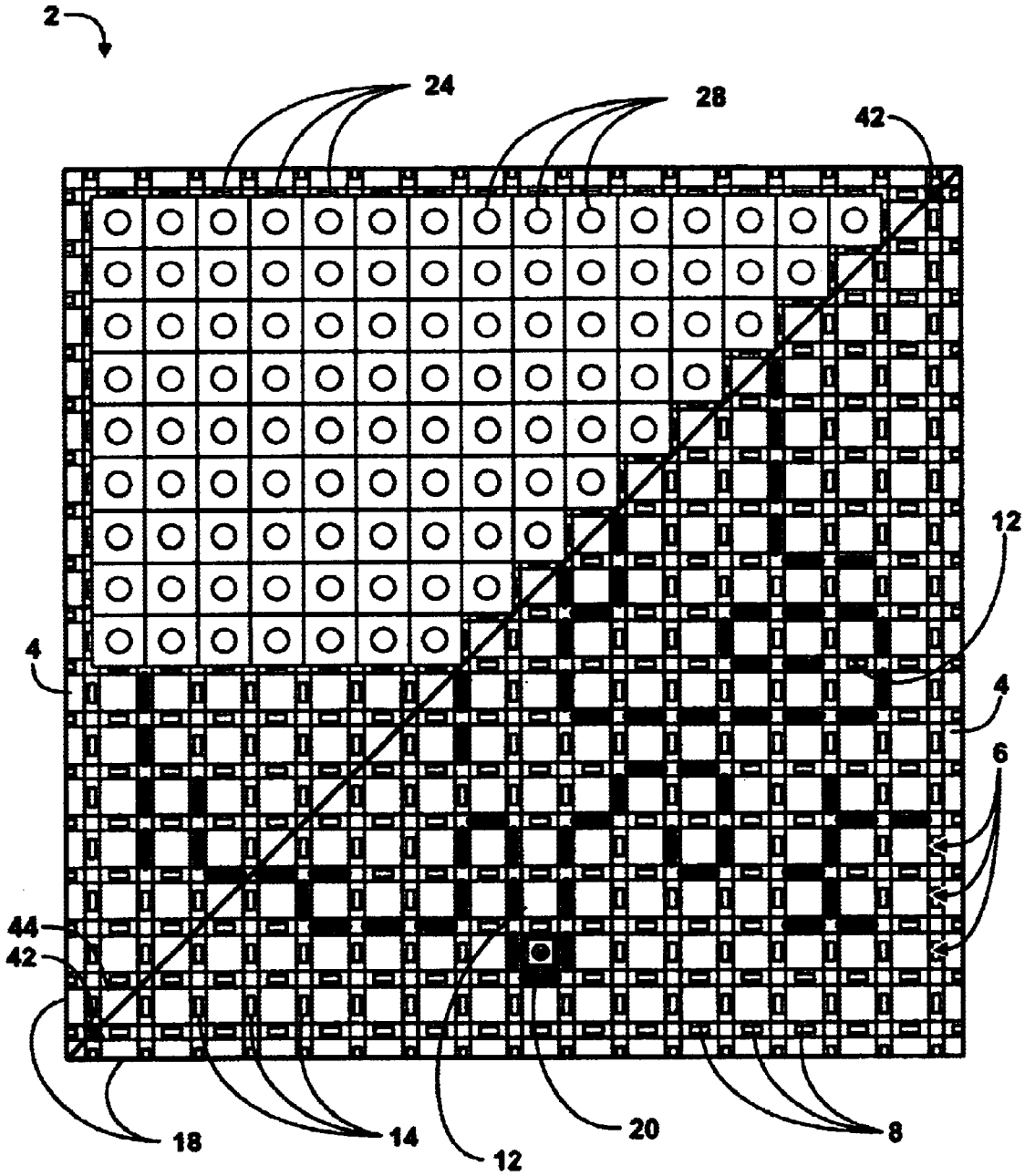
FIG. 1 is a top view of several aspects of an embodiment of the present invention.
Figure 2:
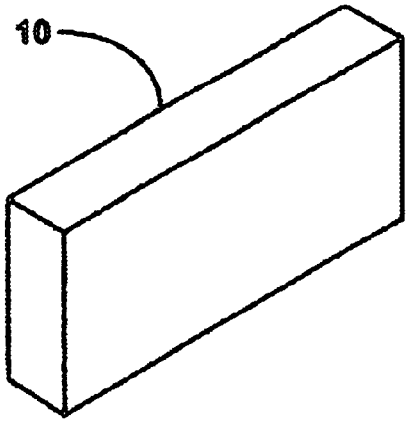
FIG. 2 is a perspective view of a partition piece 10 for use with an embodiment of the present invention.

The present invention is directed to a board game that allows players to construct, conceal and later uncover a hidden maze. With reference FIG. 1, one embodiment of the game can include a playing board 2 having a playing surface 4 on which is defined a plurality of playing spaces 6. Each playing space 6 comprises at least one recessed portion 8. A plurality of partition pieces 10 (see FIGS. 2, 4, 18, and 20) are provided. Each partition piece 10 is removably attachable to playing surface 4 at an angle substantially normal to the playing surface, thereby forming, as shown in FIG. 1, a plurality of mutable paths 12 across the playing surface.

Figure 3:
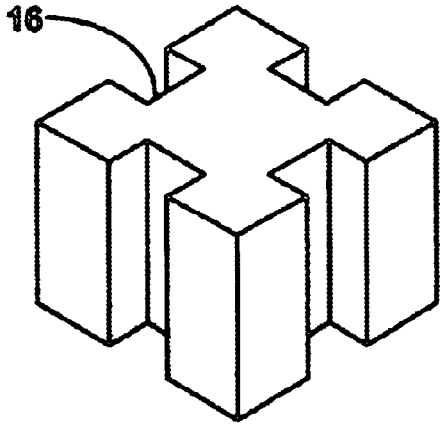
FIG. 3 is a perspective view of a substantially rigid pin of an embodiment of the present invention.
Figure 4:
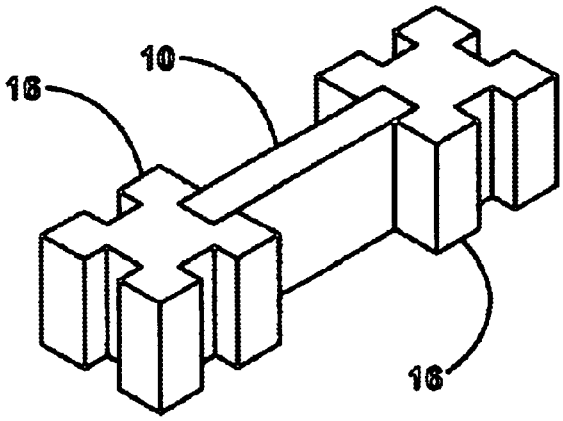
FIG. 4 is a perspective view showing the use of the items depicted in FIGS. 2 and 3.
Figure 5:
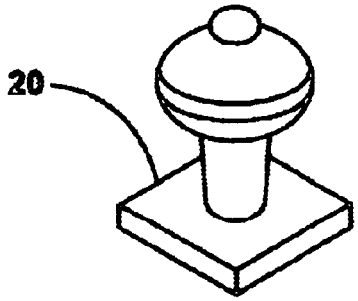
FIG. 5 is a perspective view of a game piece 20 for use with an embodiment of the present invention.
Figure 6:
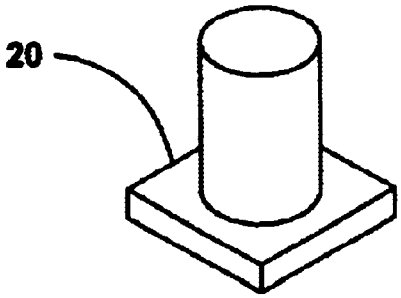
FIG. 6 is a perspective view of an alternative game piece 20 for use with an embodiment of the present invention.
Figure 7:
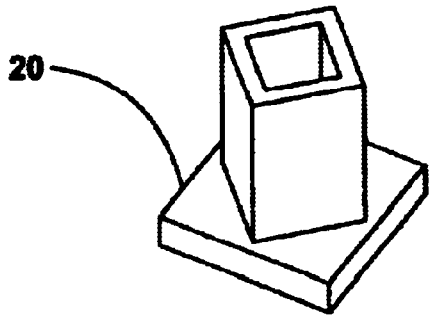
FIG. 7 is a perspective view of an alternative game piece 20 for use with an embodiment of the present invention.
Figure 8:
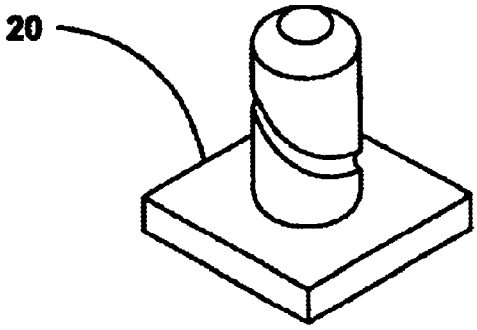
FIG. 8 is a perspective view of an alternative game piece 20 for use with an embodiment of the present invention.
Figure 18:
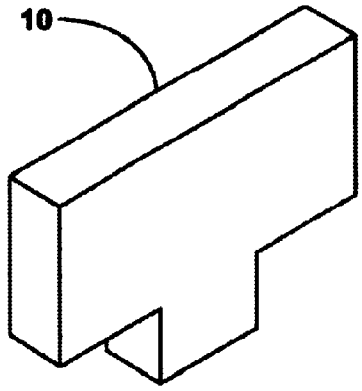
FIG. 18 is a perspective view of an alternative partition piece 10 for use with an embodiment of the present invention.
Figure 20:
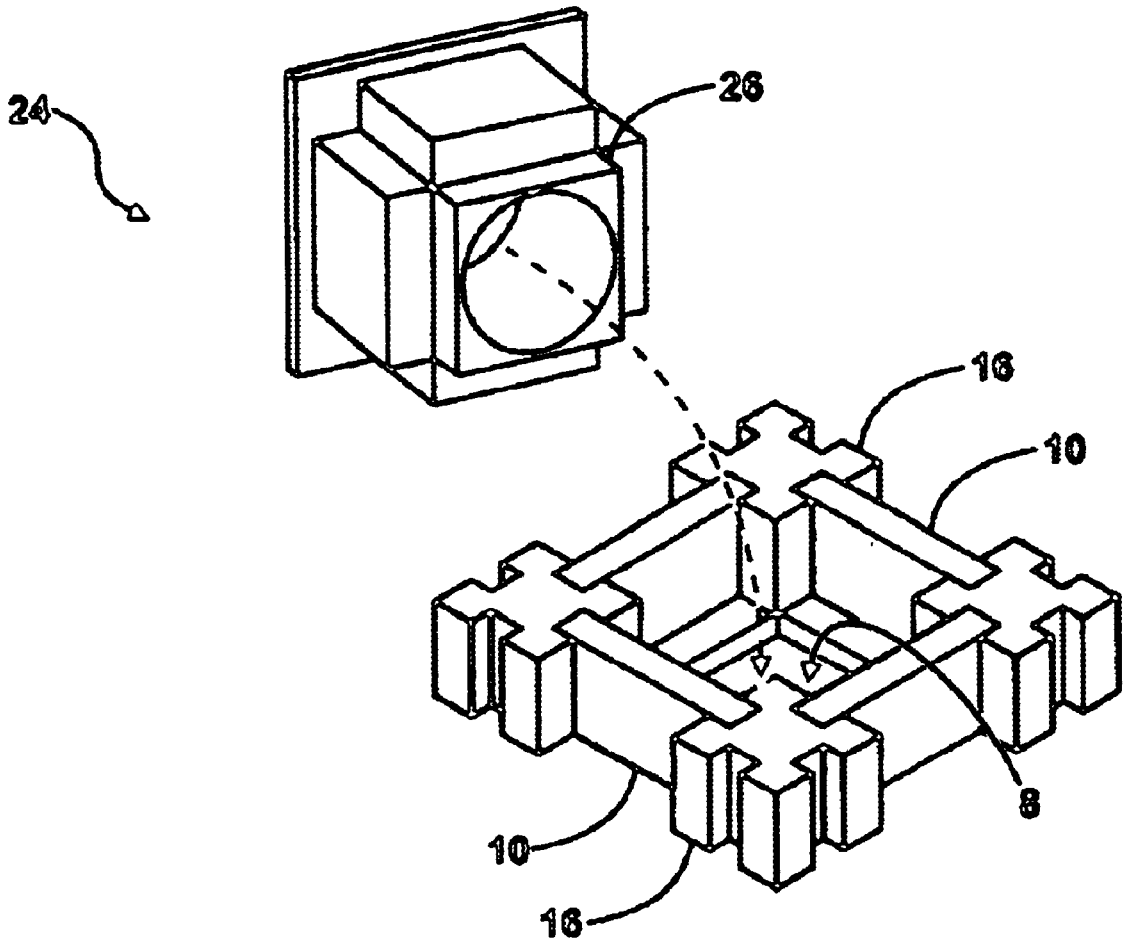
FIG. 20 is a plan view of an aspect of an embodiment of the present invention.

Each partition piece 10 is preferably held in position in a manner that allows the partition piece to maintain its substantially normal angle relative to playing surface 4 while other items are added to board 2. As shown in FIG. 1, one way to hold the partition pieces in position is to provide the board with a plurality of grooves 14, which are dimensioned to removably accept the partition pieces therein. The partition piece shown in FIG. 18 is especially suitable to be inserted in grooves on the playing surface. Alternatively, another way to hold the partition pieces in position is to provide a substantially rigid pin 16 at each corner of playing spaces 6, as shown in FIGS. 3, 4, and 20. Each face of the pins depicted in the figures is grooved to removably accept partition pieces 10 in the area between adjacent grooved pins (FIGS. 4 and 20).

Figure 16:
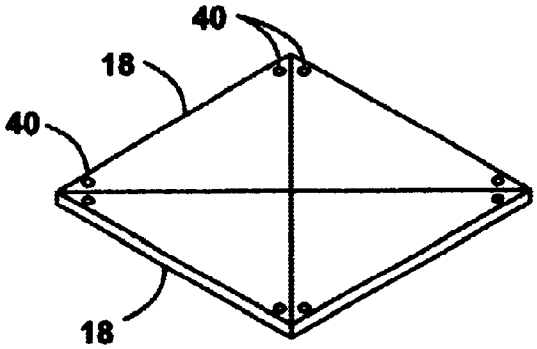
FIG. 16 is a perspective view of an aspect of an embodiment of the present invention.
Figure 19:
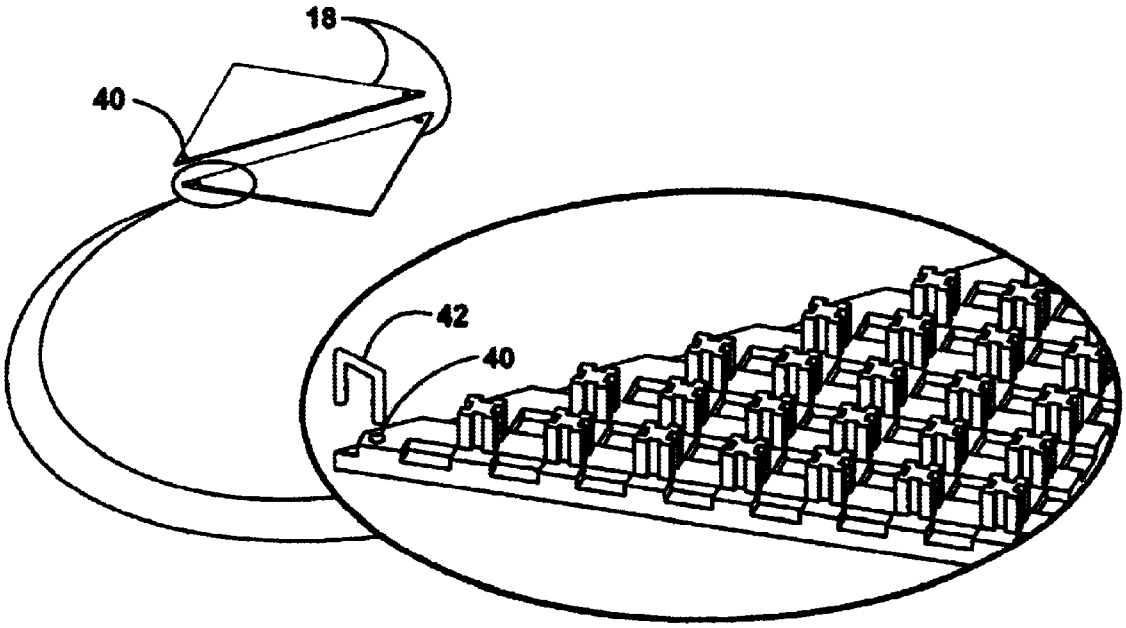
FIG. 19 is a plan view of an aspect of an embodiment of the present invention.

The playing spaces are preferably polygonal in shape and, more preferably, the playing spaces are quadrilateral to simplify construction of the mutable paths on the board. However, it is contemplated that at least one of the playing spaces can be hexagonal or another shape in order to provide additional interest to game play. In the embodiments shown, the playing spaces are arranged in an m by n array across the playing surface. This configuration allows the board to be divided into discrete, identical modules 18 (FIGS. 1, 16, and 19). In various preferred embodiments, a portion of each playing space can contain visual indicia, such as colored sections, used to classify certain playing spaces as a region on the playing surface. It will be appreciated that various game properties can be assigned to various regions of the playing surface.

Figure 9:
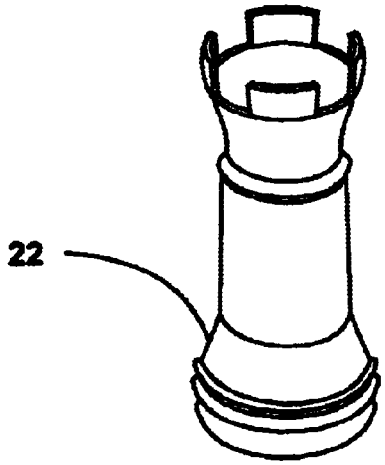
FIG. 9 is a perspective view of a player piece 22 for use with an embodiment of the present invention.
Figure 10:
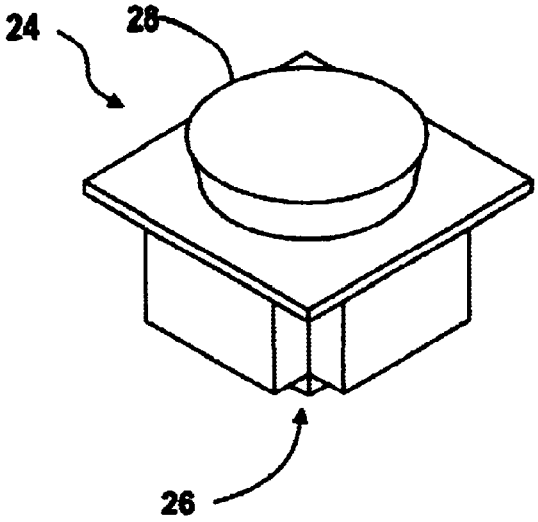
FIG. 10 is a top perspective view of a covering piece 24 for use with an embodiment of the present invention.
Figure 11:
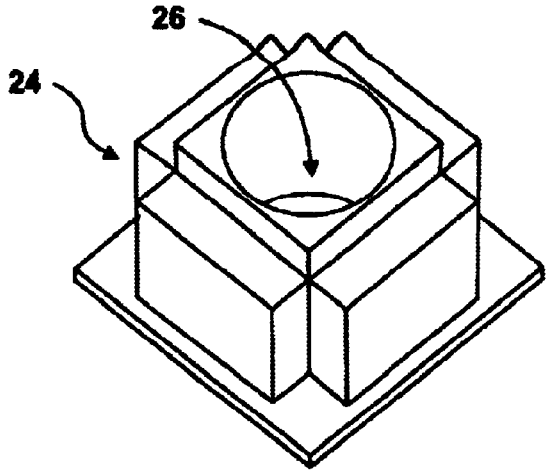
FIG. 11 is a bottom perspective view of the covering piece of FIG. 10.
Figure 12:
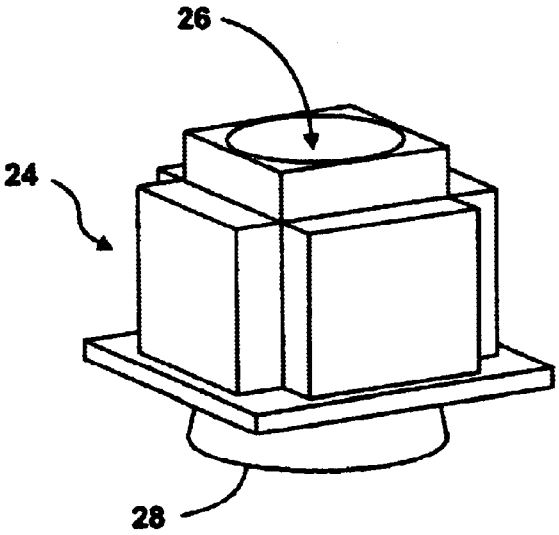
FIG. 12 is a side perspective view of the covering piece of FIG. 10.
Figure 13:
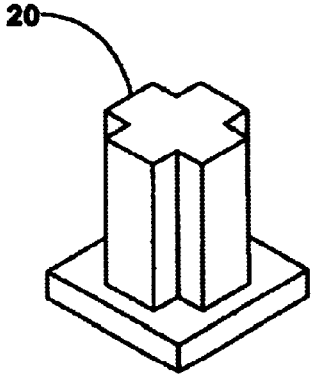
FIG. 13 is a perspective view of an alternative game piece 20 for use with an embodiment of the present invention.

The game further includes game pieces 20 dimensioned to be removably received in the recessed portion of any one of the plurality of playing spaces. In this context, "removably received" means that a portion of the game piece engages the recessed portion in a manner that facilitates alignment of the game piece with other game elements. This feature also assists in preventing lateral displacement of the game piece during setup and play. In certain embodiments, it may be adequate to provide the game pieces with small dowels (not shown) to engage the recessed portion, while in other embodiments it may be beneficial to provide deep recessed portions in order to receive more of the game piece therein. The game pieces are intended to associate an aspect of game play, such as a prize or a penalty or a player's base or goal, with the particular playing space in which the game piece is located. As such, groups of game pieces are preferably visually distinguishable from one another, as shown in FIGS. 5, 6, 7, 8, and 13. Acceptable sizes and shapes of game pieces and recessed portion can be determined by one of ordinary skill using no more than routine experimentation. In addition to the game pieces, it may be desirable to provide each player with at least one player piece 22 (FIG. 9) to represent a position of a player on the board. In addition to the distinguishing shapes shown in the FIGS, it may also be desirable to provide the game pieces in different colors to further distinguish pieces or groups of pieces. For example, in a preferred embodiment each player can be provided with a base piece which differs in color from that of any opposing player.

A plurality of covering pieces 24 are also provided; As shown in detail in FIGS. 10, 11, 12, and 20, each covering piece is dimensioned to removably engage the recessed portion of one of the plurality of playing spaces while at least partially covering any partition pieces that abut the playing space occupied by the covering piece. In preferred embodiments, the covering pieces include a hollow member 26 dimensioned to cover at least a portion of any one of the game pieces when the covering piece is received in the recessed portion of the playing space. In this context, "received" means that at least a portion of the covering piece engages the recessed portion in a manner that facilitates alignment of the covering piece with other game elements. It is possible for a single covering piece to simultaneously conceal at least a portion of a partition piece and the contents of the recessed portion of a playing space. In this manner, multiple covering pieces in combination with any player pieces can form a substantially uniform covering for the entire game board effectively covering all of the mutable paths and the contents of all playing spaces. Furthermore, because the covering pieces are discrete items, each can be removed individually during game play to reveal the contents of a playing space without revealing the contents of any other playing space (See FIG. 1). To facilitate easy removal of each covering piece, the pieces can be provided with a protrusion 28 to allow a player to more easily grasp a covering piece while it is disposed on the board.

Figure 14:
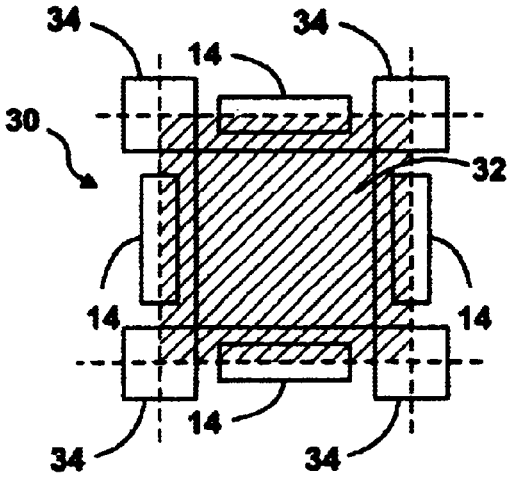
FIG. 14 is a top view of an aspect of an embodiment of the present invention.
Figure 15:
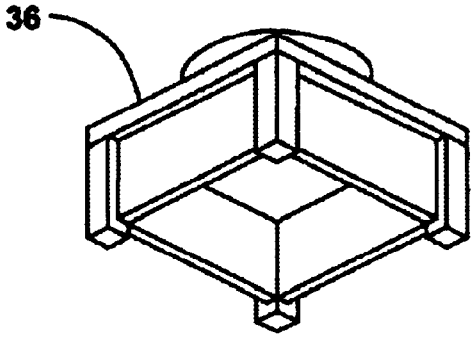
FIG. 15 is a perspective view of an alternative covering piece 36 for use with the embodiment shown in FIG. 14.

Of course, variations are possible regarding the manner in which the covering pieces engage both the game board and the game pieces. For example, FIG. 14 depicts a playing space 30 which includes a central recessed portion 32 for removably receiving a game piece and a plurality of perimeter recessed portions 34 for removably receiving a covering piece. A covering piece 36 adapted to fit into the perimeter recessed portions is shown in FIG. 15.

It may also be desirable to vary the shape of the covering pieces to accommodate variance in the shape of the playing spaces. With the present: specification as a guide, a skilled artisan can easily determine an acceptable shape for a covering piece using no more than routine experimentation.

Figure 17:
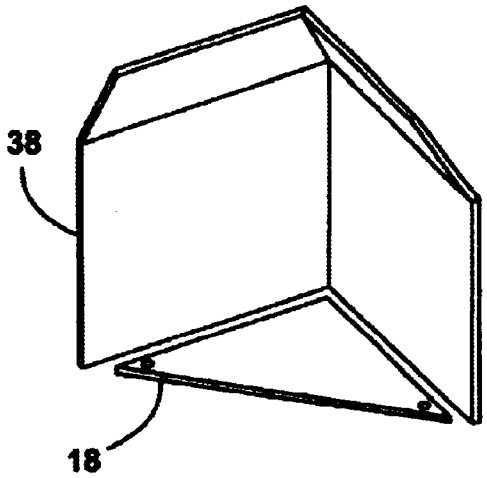
FIG. 17 is a perspective view of an aspect of an embodiment of the present invention.

Another aspect of the present invention involves the use of discrete modules 18, which are removably attached to each other to form a substantially planar playing surface. In preferred embodiments, the triangular shape of the modules allow four discrete modules to be removably attached to form a playing surface, as shown in FIG. 16. The modular configuration facilitates a two phase game in which the first phase comprises each player constructing a maze on the module or modules assigned to that player. As shown in FIG. 17, one or more opaque screens 38 can be placed between players during the setup phase of the game to provide privacy. The second phase of the game is carried out after the discrete modules are rejoined to form the playing surface.

In the embodiment shown in FIGS. 1, 16, and 19, each of the modules is provided with at least one attachment portion 40 adapted to receive a substantially rigid member 42 therein. The substantially rigid member interconnects at least two adjacent modules and is shown inserted in FIG. 1. This configuration prevents the modules from separating during game play. Furthermore, the shape of the modules along with the size of the substantially rigid member and the location of the attachment portion allow the playing board to accommodate additional modules utilizing identically dimensioned substantially rigid members. It will be appreciated that the substantially rigid member can be provided in many different shapes. For example, the member can be a planar member rotatably attached at one end to one of the modules and having a hook or other form at its opposite end for attaching to a pin or other protrusion of a second module.

When an m by n array of playing spaces is employed, it will be possible to dimension the modules such that at least one of the outermost rows of the playing spaces is bisected 44 (FIG. 1), thereby allowing a portion of the row to remain on each of two modules when the modules are separated. With this configuration, it may be desirable to place covering pieces on the bisected row after the modules have been rejoined and the row has been fully reformed.

Game play can vary according to the wishes of the players. An exemplary method of game play involves providing partition pieces, covering pieces and game pieces to each of at least two players. Preferably, the game pieces include at least one base piece for each player. A playing board is provided comprising a plurality of playing spaces. The board is adapted to receive the partition pieces, covering pieces and game pieces, such as described supra. Game play according to this method includes a setup phase and a playing phase. For convenience, the playing board can include visually discernible sections of playing spaces with each of the sections being assigned to one of the players. During setup, each player places one of his base pieces on one of the plurality of playing spaces in his section. The players place the partition pieces on the playing board in a manner that defines a plurality of paths. The player can also place additional game pieces on various playing spaces. Of course, these steps can be performed in any order according to player preference. In a preferred embodiment, it is required that at least one of the paths allows access to the player's base piece. Each player conceals his base piece and at least a portion of the plurality of paths with the covering pieces to form a hidden maze. In a preferred embodiment, each player substantially conceals his entire maze with covering pieces.

In addition to a base piece, the game pieces can also include specialty pieces, each of which can be placed on a playing space and concealed by a covering piece. Examples of specialty pieces include traps, which result in a penalty when a player piece is placed on the playing space occupied by one of the traps, and prizes, which result in a benefit when an opposing player uncovers the playing space occupied by one of the prizes. The prize can be predetermined or randomly determined, such as by drawing a card.

It is useful to provide each player with at least one player piece in order to represent that player's position on the board during the playing phase. In various embodiments, it may be desirable to require each player to place his player piece within the maze formed by that player, thereby making it necessary for that player to move his player piece through a portion of his own hidden maze before reaching the hidden maze of any opposing players. In a preferred embodiment of the game, the specialty pieces include scatterports, which dictate movement of the player piece to another playing space. The destination can be determined randomly.

It is preferable that the setup phase of game play is carried out in a manner that prevents any opposing players from determining the locations of the base piece, partition pieces, and any game pieces prior to the playing phase of the game. To facilitate privacy during setup, it is preferable that the playing board comprise at least two discrete, connectable modules—as described supra. Each of the modules can be assigned to one of the players, with each player performing the setup phase on the assigned modules. There are many ways to ensure privacy during the setup phase. For example, each player can take her or his module to a different room. Alternatively, a substantially opaque dividing member can be placed between players prior to the setup phase and removed prior to the playing phase. Preferably, the substantially opaque dividing member does not allow a player to view any items or activity on the opposite side.

Many variations of the module concept are possible. For example, the playing board can comprise at least four, discrete connectable modules, with each being assigned to one of four players. Alternatively, four modules can be assigned to two players, with each player receiving two modules. In a further alternative embodiment, three players can play the game with four modules, with one player being assigned two modules and the other two players receiving one module apiece. If desired, teams of two or more people can function as a player. When teams are involved, each team member can be assigned a task, such as the setup phase or a portion of the setup phase or team members can share in the decision making throughout the game.

If a modular game board is provided, the modules should be joined together to form a single playing surface before the playing phase commences. With certain board configurations, such as when portions of a row are located on more than one module, it may be desirable to cover the playing spaces of the bisected row before the playing phase begins.

The playing phase involves a first player uncovering a portion of the hidden maze formed by an opposing player. The players take turns uncovering portions of an opponent's maze with a goal to uncover at least one base piece concealed by an opposing player or players. In a preferred embodiment the maze is revealed in a stepwise manner by removing discrete covering pieces, which allow players to view the portion of the maze initially concealed by the covering piece during the setup phase. Progress during the playing phase can be determined by the number of partition pieces encountered as well as the number and identity of game pieces uncovered.

EXAMPLE

Although a multitude of variations are possible, the following proposed game rules are being provided to further enable those of ordinary skill to understand and practice the disclosed invention. These rules are illustrative and, as such, are not intended to limit the use of the invention in any capacity.

Section I—Basic Rules

1. Introduction

The game can easily accommodate two, three or four players. Players take turns to move through an initially hidden maze. The winner is the first player to find his opponents' secret base or bases. Players construct their own secret portion of the maze and use walls and various traps to try and slow their opponents from getting to their base before they can find their opponents' base.

2. Overview

The basic two-player game takes approximately 30 minutes to play. The game consists of two phases. In the first phase each player takes their own portion of the maze board and in secret they place their base, walls and traps according to the rules in section 4. They then place the covering pieces over their maze so that it is concealed from the other player or players. The players then join all their mazes together to form the game board and the second phase of the game begins. In the second phase each player takes turns to move their game piece to try and find their opponents' base before their opponent finds theirs. The winner is the first player to find their opponents' base or bases.

3. Components

A game contains the following pieces:

3.1. diagonal maze boards
3.2. board locking pins
3.3. wall section pieces
3.4. covering pieces
3.5. screens
3.6. different colored base pieces
3.7. different colored player pieces
3.8. Goody Cards
3.9. Goody Squares
3.10. Glue Traps
3.11. Smelly Pits
3.12. Scatterports—these are used in the optional rules
3.13. six sided dice—these are used in the optional rules

4. Maze Setup

At the start of the game each player takes their maze board and all their allowed pieces and, making sure that the other players cannot see them, start constructing their maze. The screens should be used to stop peeping but if this is still a problem, then players can take their maze to another room to do the setup. If this happens then players should agree beforehand on a strict time limit on how long the setup should take. A 10-minute time limit is recommended for experienced players and 15 minutes for inexperienced players.

In the standard game each player has the following number of pieces:

66 covering pieces
36 wall section pieces
1 base piece
1 player piece of the same color as the base piece
8 Goody Squares
4 Glue Traps
2 Smelly Pits The following rules must be adhered to when setting up the maze:

4.1 The base piece must be located somewhere within the central section of the maze board—the central section is the area colored in green.

4.2 There are strict limits on how many separate wall sections can be linked together to form a continuous wall. The following are the maximum limits on what can be placed:

1×seven or eight section wall
2×five or six section walls
2×four section walls
Any number of shorter (one, two or three section) walls Wall sections are considered 'joined' together when they share a common connecting pin.

If a player decides that they do not need a longer section wall then they can use the 'allowance' for that wall to build a shorter wall. For example, if they decide not to use the seven or eight section wall then they could have three five or six section walls (instead of the normal two).

4.3 Traps (Glue Traps or Smelly Pits) may not be placed next to each other, except when there is a wall separating the traps. Note that as movement is not allowed along the diagonals, then traps can be placed diagonally adjacent to each other.

4.4 Walls and traps may not be placed on or touching any of the 'half squares' at the extreme edge of the board. When the board is joined together the half squares along the join become complete squares and normal movement through them is allowed. They in effect act as a clear "corridor" that will benefit all players' movement.

4.5 A player may not construct their walls in such a way as to completely block access to any of the squares in their section of the board.

4.6 Each player must construct their maze in such a way as to contain a 'secret path.' The secret, path is defined as a route: from the players' base to each side of the board facing their opponents, which is free of any obstructions (walls and traps). A player can include more than one 'secret path' but there MUST be at least one. In the two-player game where mazes are joined along the diagonal side, there must be one secret path to that side, and in the four-player game that is joined along both of the shorter sides there must be a secret path to each of those sides.

4.7 Goody Squares must be placed within the three yellow colored areas. The only restriction on placement is that each of the three areas must contain at least one Goody Square each. Goody Squares do not count as obstructions; in other words, they may be placed on secret paths. You must place all of the goody squares that you start with; you cannot decide to 'hold some back' during the initial setup.

4.8 Players must place their player piece on one of the allowable start squares within their own maze. In the two-player game, the player piece must be located on one of the start squares marked with the number "2." In the four-player game, the player piece must be located on one of the start squares marked with the number "4." Note that players may place traps or goody squares under their player piece at the start. If they place their piece on a trap they are not penalized for that trap at the start of the game.

4.9 Once the maze is completed, place covering pieces over all of the squares except for the one containing the player piece.

5. Joining the Mazes Together

5.1. Setup Mechanics

Once each player has constructed their maze, the game board is joined together using the locking pins. In the two-player game, players join their mazes along the diagonal using the locking holes marked with the red triangles. In the four-player game, the players join their mazes along the non-diagonal edges using the red triangle locking holes as well as the red square locking holes in the center of the game board.

5.2. Half Squares

It should be noted that the "half squares" along the outside border of the completed game board may not be moved through at any time. They in effect do not exist. The outermost line of connecting pins marks the playing area of the game board.

5.3. Violation of Setup Rules

Because of the secretive nature of the setup it is possible that a mistake (a violation of the setup rules) will be found as the game progresses. If during the course of the game a player discovers that another player has violated one of the setup rules then that player is immediately entitled to pick up two extra goody cards for each violation that they uncover. In addition, if a player violates either rule 4.1, rule 4.5 or rule 4.6 then they immediately forfeit the game.

6. Goody Squares and Goody Cards 6.1. Goody cards give players special powers in the game. They allow them to do various things, including climbing over walls and moving extra turns. The Almanac Section lists all of the card types and their capabilities.

6.2. At the start of the game, the Goody Card deck is shuffled and two cards are dealt (face down) to each player. The remaining deck is placed face down on the table. Players look at their cards and keep them secret from the other players until they decide to use them. As soon as a player has used a card, it is placed face down at the bottom of the card deck.

6.3. Players acquire extra cards when they move through or land on an opponents' goody square. When a player does this, they receive the top card from the Goody Deck and the Goody Square is picked up from the game board and removed from play. If a player moves through or lands on a Goody Square in their own section of the board, they do not receive a Goody Card and the Goody Square remains on the board until it is moved through or landed on by another player.

6.4. Goody Squares may not be placed next to one another even if a wall separates them, although they can be diagonally adjacent. Goody Squares can be placed next to traps.

6.5. When placing your Goody Squares, it is worth remembering that they will greatly benefit your opponent and therefore some effort should be made to conceal or protect them. Also, try not to place them on your planned 'exit route' from your chosen start square through to your opponents maze as they will be revealed by your own player piece as you move through your maze.

6.6. Goody Cards may only be played within a player's turn. If a player has to miss a turn (or turns) for any reason, then they may not play Goody Cards for those missed turns either.

6.7. During their turn, players can play any number of their Goody Cards. They could for example play a 'spy' card to reveal hidden squares, then move their normal turn and then play an 'energy' card at the end of their turn to move extra squares.

7. Movement 7.1. Starting with the youngest player, play moves clockwise around the board. In the event that players share the same birth date (or do not want to reveal their age!), decide the tie by choosing the player whose name appears last in alphabetical order.

7.2. In a players' turn they may move up to four times. A player is allowed to move to an adjacent square that has no wall blocking it. Note that movement along diagonals is NOT permitted at any time.

7.3. The player whose turn it is announces each move by picking up their player piece and moving it to the adjacent square, removing the covering piece if it is still present. If the player lands on a square containing a trap (a Glue Trap or a Smelly Pit) they immediately end their turn. If they land in a Smelly Pit then they miss their next entire turn as well. Note that traps do not distinguish between friend and foe. A player can be stuck in their own trap if they are foolish enough to land in one! Once a player has moved their piece four times (or landed in a trap) their turn is over and play moves to the next player.

7.4. A player can double back on themselves and re-cross squares as often as they like although each time they land in a trap they still have to pay the penalty.

7.5. Note that a 'reconnaissance move' is not allowed. In other words, if a player cannot move into a square because a wall blocks it, then they may NOT remove the covering piece for that square just to see what the square contains.

7.6. Players may move through squares containing another player but may not end their turn in the same square as another player. If they do not have enough movement allowance to pass through another player then they must stop short of that player. If the player that they are attempting to move through is in a trap, then that trap is still in effect for the moving player. The only way they could pass the trapped player would be to play a Goody Card that negates the trap.

8. Victory Conditions

In the standard two-player game, the game is over as soon as a player lands on or moves through their opponents' base. In the four-player game, the game is over when a player manages to land on or moves through any two of their opponents' bases. Note that a player must visit an opponents.' base for it to count, in other words if they 'find' an opponents base using a spy card, their player piece must still move through or land on the base for it to count as being visited.

9. Optional Rules

The following rules may be used in various combinations depending on mutual agreement of the players. Note that some of the rules will significantly alter the balances and/or length of the game.

9.1. Standard Three-Player Game

Construct a three-player game like a four player game except that one player gets to construct two mazes. (A suggestion is to rotate which player gets to do this in multiple rounds of the game). The player constructing the two mazes may not transfer pieces from one of their mazes to the other maze. Also, this player has only one playing piece—the player decides which maze he wants his playing piece to start from. These two mazes are treated as separate bases from the point of view of victory conditions. This means that other players can win just by visiting both of these mazes as they each contain a base. The player with the two mazes must visit both of his opponents' bases to win—he cannot visit his other maze to win! When the mazes are joined, the two-maze player places his mazes diagonally opposite each other.

9.2. Long Two Player Game using a Four Player Board.

Each player gets two mazes at the start and two complete sets of walls, Glue Traps etc. Also, the pieces may be transferred between mazes with the exception of the bases, which must be placed within the start squares of each maze. When the mazes are joined in this version of the game, each player joins their two mazes together first before joining them with their opponent. The start squares are the same as for the four-player game: each player decides which of their mazes they wish to start from. To win the game a player must visit both of his opponents' bases.

9.3. Handicapped Game

To help balance the game, it is suggested that younger or less experienced players get more walls and traps to help defend their base. The following is suggested:

9.3.1. Slight Advantage: 40 wall sections, and one extra Glue Trap. One extra four section wall allowed.

9.3.2. Moderate Advantage: 44 wall sections, and one extra Smelly Pit. One extra five or six section wall allowed. One extra Goody Card at the start of the game.

9.3.3. Heavy Advantage: 50 wall sections, one extra Glue Trap and one extra Smelly Pit. One extra seven or eight section wall and one extra four section wall allowed. One extra Goody Card at the start of the game.

9.4. Campaign Game

Play several rounds of the standard (two, three or four player game) but play does not stop when the first player finishes. Instead the other player or players continue to play until all players have successfully visited their opponents' bases. The first player to finish notes how many complete turns it takes for each of the other players to finish and a tally is kept to record how many points each player has. At the end of a pre-agreed number of rounds the player with the most points wins. An example of the scoring is as follows:

Example: Player A finishes. Three turns later player B finishes followed by player C and player D in the fifth turn. Player A gets 13: points (3 turns ahead of B, plus five turns for C and five turns for D). Player B gets 4 points (he finished 2 turns ahead of player C and 2 turns ahead of player D). Player C gets no points (he finished in the same turn as player D), Player D also gets no points.

9.5. Two Base Game

Each player starts with two bases that must be placed in the allowed start area. Each base must have a 'secret path.' In the two-player game, a player must visit both of his opponents' bases to win. In the three or four player game a player must visit any three of his opponents' bases to win (he could for example visit both bases of one player and one base of one of the other players).

9.6. Two Playing Piece Game

Each player has two playing pieces. These must be placed in the allowable starting squares. When a player moves, they decide each turn how much to move each piece within the movement rules. They could for example move one of their pieces three squares and the other piece one square. As with the standard game, a player's turn ends immediately if either one of their pieces falls into a trap.

9.7. Scatterports

Scatterports are random teleports and may not be placed on secret paths. When a player lands on a Scatterport the two dice are rolled to decide where the player is to end up. The dice are rolled once and totaled and a note kept of the number. They are rolled again, and totaled and the second number is also noted. These two numbers represent the coordinates within the maze where the players' piece is to land. Note that a player is not teleported beyond the maze that they are in. If the coordinates point outside of the maze, then reverse the coordinates and place the piece there instead. If the coordinates still point outside of the maze roll the dice again to set new coordinates.

10. Listing of Goody Cards 10.1. The 'Mad Scramble' Card and Scuffed Knees

A 'Mad Scramble' card allows your player piece to frantically scramble their way over one wall section in your turn. The wall section can be one of yours or an opponents.' The 'Mad Scramble' does not cost any extra movement allowance. So long as you have at least one movement point left to move into the square beyond the wall you can play the 'Mad Scramble' card. A mad scramble is a temporary thing, your player piece gets scuffed knees during a mad scramble and so the card can only be used once and only on one wall section.

10.2. The Demolition Card

You play this card just before you move to a square that is blocked by a wall section. The Demolition card permanently destroys that wall section. Simply pick up and remove the wall section from the board.

10.3. The 'Magic Cape' Card

You play this card just before you are about to fall into a Glue Trap or a Smelly Pit. The Magic Cape is magically whisked down before you and protects your player piece from falling into any trap for the remainder of the turn.

10.4. The Cleanup Card

A Cleanup card allows you to permanently remove a Glue Trap or a Smelly Pit from the board. It is good to remove these pesky obstructions if you crossed one only to find yourself in a dead end that your opponent had cunningly constructed to slow you down. A Cleanup card may be played if you have just revealed a trap and are about to fall into it (similar to a Magic Cape card). Note that unlike a Magic Cape card this only works on ONE trap.

10.5. Energy Bar Cards and Extra Turns

There are two types of Energy Bar cards. The 'standard' and the 'super.' Energy Bar cards represent you finding a nice stack of these delicacies that have been improbably left in the maze. A 'standard' card allows your player piece one whole extra turn of movement and a 'super' card allows your player piece two extra turns of movement. If you are fortunate enough to have more than one of these cards you can use them together in one turn to really move a long way! Note that Energy Bar cards are ineffective for 'powering through' a trap—unless you play a card that protects you from a trap, you must end your turn once you hit a trap regardless of how much extra movement the Energy Bar Cards give you.

10.6. The Spy Cards

Spy cards allow you to reveal 'hidden' squares anywhere in the maze. Spy cards come in three flavors: 'Standard,' 'Super' and 'Ultra.' A 'Standard' card allows you to reveal one hidden square. Simply remove the covering piece from that square. A 'super' card allows you to reveal two hidden squares and an 'Ultra' card reveals three hidden squares. You may reveal your own hidden squares if you wish. Note that anytime a covering piece is removed during the game it is never replaced.

10.7. Extra Glue When you spot one of your opponents flailing in a Glue Trap (not a smelly pit!) you get to pour Extra Glue into that trap and delay their escape. When you play this card, your opponent must stay in the Glue Trap for one or two whole additional turns depending on whether you have 'Standard' or 'super' glue. Very handy indeed if they are about to find your base! Extra glue only works once, it does not make the trap super sticky permanently.

10.8. The Extra Goody Card

When you play this card you immediately pick up two Goody Cards from the Goody Deck.

10.9. The Thief Card

You must play this card at the start of your turn (before you start moving) and when you do, you get to steal a Goody card from one of your opponents! You have to select which player you are going to steal from and you get to see all of their Goody cards. You then choose one card from their hand for yourself. You may not reveal which card you stole (until you are ready to play it), nor may you reveal which cards your opponent has to any of the other players. If you do this, you must return that card to the player plus one of your own Goody cards (you choose which one). A special exception to this rule is that if your opponent has an 'Absolutely Nothing' card (see below) then you must choose this card to take over any of the others.

10.10. The 'Absolutely Nothing' Card and Why it Can Be Useful

An 'Absolutely Nothing' card is just that—you cannot do anything with it. Keep it in your hand though instead of just throwing it away in disgust. Remember that it is a secret card and your opponents may be scared about what it could be. Also—this can be sweet revenge if your opponent plays a Thief card on you and then finds that you have an 'Absolutely Nothing' card that they must steal!

10.11. The 'Constructor' Card

This card is only used in the 3 and 4 player games. Remove this card from the deck in the 2-player game. The 'Constructor' card permits you to take up to six wall sections and build one or more extra walls anywhere on the board. Note that the following restrictions apply:

You may not join the new wall or walls to any existing walls.

You may not block off access to ANY square. In other words the board must be sufficiently revealed to show that access to any square is not being denied by this action.

You may not remove any covering pieces to place the wall sections.

Note that you may place the new walls outside of your own starting maze section and you are also permitted to place them across the blue colored border squares formed when the maze sections are joined together. In addition, you can ignore 'secret path' requirements when building the new wall or walls.

10.12. The 'Mad Constructor' Card

This card is only used in the 3 and 4 player games. Remove this card from the deck in the 2-player game. The 'Mad Constructor' card permits you to add one extra wall section anywhere on the board. The placement rules in section 10.11 above apply for this card with the following exception: Unlike the regular constructor card you MAY use this card to extend an existing wall or to join together two existing walls to make a much longer wall. There is no limit to the length of the wall that may be formed by this action.

It will be understood that each of the elements described above, or two or more together, may also find utility in applications differing from the types described herein. While the invention has been illustrated and described as embodied in a modular hidden maze game, it is not intended to be limited to the details shown, since various modifications and substitutions can be made without departing in any way from the spirit of the present invention. For example, numerous combinations of players, teams, and module assignments can allow for entertainment of groups of two to ten or more. Although many examples of various alternative game play methodology and game board configurations have been presented throughout this specification, the omission of a possible scenario is not intended to specifically exclude its use in or in connection with the claimed invention. As such, further modifications and equivalents of the invention herein disclosed may occur to persons skilled in the art using no more than routine experimentation, and all such modifications and equivalents are believed to be within the spirit and scope of the invention as defined by the following claims.

What is claimed is:

1. A board game, comprising:

a playing board having a playing surface on which is defined a plurality of playing spaces, each of the playing spaces comprising at least one recessed portion;

a plurality of partition pieces removably attachable to the playing surface at an angle substantially normal to the playing surface, thereby forming a plurality of mutable paths across the playing surface; and a plurality of covering pieces, each of the covering pieces being dimensioned to removably engage the at least one recessed portion of one of the plurality of playing spaces while at least partially covering any partition pieces that abut the playing space occupied by the covering piece, wherein a plurality of the playing spaces and the contents thereof are at least partially concealed by discrete covering pieces such that any one playing space and the contents thereof can be revealed without revealing the contents of any other playing space by removing the covering piece disposed in the recessed portion of the playing space to be revealed.

2. The board game of claim 1, wherein the playing surface comprises a plurality of grooves, which are dimensioned to removably accept the partition pieces therein.

3. The board game of claim 1, wherein the playing spaces are arranged in an m by n array across the playing surface.

4. The board game of claim 1, wherein a portion of each playing space contains visual indicia used to classify the playing space as a region on the playing surface.

5. The board game of claim 1, further comprising player pieces to represent a position of a player on the board.

6. The board game of claim 1, wherein the playing spaces are polygonal.

7. The board game of claim 6, wherein each corner of the playing spaces is defined by a portion of a substantially rigid pin, said pin being located at the intersection of playing spaces and being grooved to removably accept the partition pieces therein.

8. The board game of claim 6, wherein at least one of the playing spaces is quadrilateral.

9. The board game of claim 6, wherein at least one of the playing spaces is hexagonal.

10. The board game of claim 1, wherein the playing board comprises at least two discrete modules, which are removably attachable to form the playing surface.

11. The board game of claim 10, wherein the playing board comprises at least four discrete modules.

12. The board game of claim 1, further comprising game pieces dimensioned to be removably received in the recessed portion of any one of the plurality of playing spaces.

13. The board game of claim 12, wherein each of the plurality of covering pieces comprises a hollow member dimensioned to cover at least a portion of any of the game pieces when the covering piece is received in the recessed portion of the playing space.

14. The board game of claim 12, wherein some of the game pieces are penalty pieces.

15. The board game of claim 12, wherein some of the game pieces are prize pieces.

16. The board game of claim 12, wherein substantially all of the playing spaces and any game pieces are at least partially concealed by discrete covering pieces such that any one playing space and the contents thereof can be revealed without revealing the contents of any other playing space by removing the covering piece disposed in the recessed portion of the playing space to be revealed.

17. The board game of claim 16, wherein each of the playing spaces comprises a first recessed portion for removably receiving a game piece and a second recessed portion for removably receiving a covering piece.

18. A board game, comprising a playing board formed of at least two discrete modules removably attached together to form a substantially planar playing surface and a plurality of partition pieces removably attachable to the playing surface at an angle substantially normal to the playing surface thereby forming a plurality of mutable paths across the playing surface, wherein a plurality of playing spaces are defined on the playing surface, each of the playing spaces comprising at least one recessed portion, and a plurality of covering pieces, each of the covering pieces being dimensioned to removably engage the recessed portion of one of the plurality of playing spaces while at least partially covering any partition pieces that abut the playing space occupied by the covering piece.

19. The board game of claim 18, wherein the playing surface comprises a plurality of grooves, which are dimensioned to removably accept the partition pieces therein.

20. The board game of claim 18, wherein the playing spaces are polygonal and each corner of the playing space is defined by a portion of a substantially rigid pin, said pin being located at the intersection of playing spaces and being grooved to removably accept the partition pieces therein.

21. The board game of claim 18, wherein the playing spaces are arranged in an m by n array across the playing surface.

22. The board game of claim 18, wherein a portion of each playing space contains visual indicia used to classify the playing space as a region on the playing surface.

23. The board game of claim 18, wherein the playing board comprises at least four discrete modules.

24. The board game of claim 18, further comprising player pieces to represent a position of a player on the board.

25. The board game of claim 18, further comprising game pieces dimensioned to be removably received in the recessed portion of any one of the plurality of playing spaces.

26. The board game of claim 25, wherein each of the playing spaces comprises a first recessed portion for removably receiving a game piece and a second recessed portion for removably receiving a covering piece.

27. The board game of claim 25, wherein some of the game pieces are penalty pieces.

28. The board game of claim 25, wherein some of the game pieces are prize pieces.

29. The board game of claim 25, wherein each of the plurality of covering pieces comprises a hollow member dimensioned to cover at least a portion of any of the game pieces when the covering piece is received in the recessed portion of the playing space.

30. The board game of claim 29, wherein substantially all of the playing spaces and any game pieces disposed in the recessed portions thereof are at least partially concealed by discrete covering pieces such that any one playing space and the contents thereof can be revealed without revealing the contents of any other playing space by removing the covering piece disposed in the recessed portion thereof.

31. A board game, comprising a playing board formed of at least two discrete modules removably attached to form a substantially planar playing surface, each of the modules having at least one attachment portion adapted to receive a substantially rigid member which interconnects at least two adjacent modules, the modules being shaped and the substantially rigid member being sized and the attachment portion being located such that the playing board can accommodate additional modules utilizing identically dimensioned substantially rigid members, a plurality of partition pieces removably attachable to the playing surface at an angle substantially normal to the playing surface, thereby forming a plurality of mutable paths across the playing surface, wherein a plurality of playing spaces are defined on the playing surface, each of the playing spaces comprising at least one recessed portion, and a plurality of covering pieces, each of the covering pieces being dimensioned to removably engage the recessed portion of one of the plurality of playing spaces while at least partially covering any partition pieces that abut the playing space occupied by the covering piece.

32. The board game of claim 31, wherein the playing surface comprises a plurality of grooves, which are dimensioned to removably accept the partition pieces therein.

33. The board game of claim 31, wherein the playing spaces are polygonal and each corner of the playing spaces is defined by a portion of a substantially rigid pin being located at the intersection of playing spaces and being grooved to removably accept the partition pieces therein.

34. The board game of claim 31, wherein the playing spaces are arranged in an m by n array across the playing surface.

35. The board game of claim 31, wherein a portion of each playing space contains visual indicia used to classify the playing space as a region on the playing surface.

36. The board game of claim 31, wherein the playing board comprises at least four discrete modules.

37. The board game of claim 31, further comprising player pieces to represent a position of a player on the board.

38. The board game of claim 31, further comprising game pieces dimensioned to be removably received in the recessed portion of any one of the plurality of playing spaces.

39. The board game of claim 38, wherein some of the game pieces are penalty pieces.

40. The board game of claim 38, wherein some of the game pieces are prize pieces.

41. The board game of claim 38, wherein each of the plurality of covering pieces comprises a hollow member dimensioned to cover at least a portion of any of the game pieces when the covering piece is received in the recessed portion of the playing space.

42. The board game of claim 41, wherein substantially all of the playing spaces and any game pieces disposed in the recessed portions thereof are at least partially concealed by discrete covering pieces such that any one playing space and the contents thereof can be revealed without revealing the contents of any other playing space by removing the covering piece disposed in the recessed portion thereof.

43. A board game, comprising a playing board having a playing surface on which is defined a plurality of playing spaces, each of the playing spaces comprising at least one edge recessed portion along an edge of the playing space and at least one corner recessed portion at a corner of the playing space, a plurality of partition pieces removably attachable to the playing surface at one of the edge recessed portions at an angle substantially normal to the playing surface, thereby forming a plurality of mutable paths across the playing surface; and a plurality of covering pieces, each of the covering pieces being dimensioned to removably engage the at least one corner recessed portion of one of the plurality of playing spaces while at least partially covering any partition pieces that abut the playing space occupied by the covering piece.

44. The board game of claim 43, wherein a portion of each playing space contains visual indicia used to classify the playing space as a region on the playing surface.

45. The board game of claim 43, wherein the playing board comprises at least two discrete modules.

46. The board game of claim 43, further comprising player pieces to represent a position of a player on the board.

47. The board game of claim 43, further comprising game pieces dimensioned to be removably received in any one of the plurality of playing spaces.

48. The board game of claim 47, wherein some of the game pieces are penalty pieces.

49. The board game of claim 47, wherein some of the game pieces are prize pieces.

50. The board game of claim 47, wherein each of the plurality of covering pieces comprises a hollow member dimensioned to cover at least a portion of any of the game pieces when the covering piece is received in the at least one corner recessed portion of the playing space.

51. The board game of claim 50, wherein substantially all of the playing spaces and any game pieces are at least partially concealed by discrete covering pieces such that any one playing space and the contents thereof can be revealed without revealing the contents of any other playing space by removing the covering piece disposed in the at least one corner recessed portion thereof.

* * * * *